US009119453B1

(12) United States Patent
LaRocque

(10) Patent No.: US 9,119,453 B1
(45) Date of Patent: Sep. 1, 2015

(54) MODULAR LUGGAGE TRANSPORT SYSTEMS

(71) Applicant: Michael LaRocque, San Diego, CA (US)

(72) Inventor: Michael LaRocque, San Diego, CA (US)

( * ) Notice: Subject to any disclaimer, the term of this patent is extended or adjusted under 35 U.S.C. 154(b) by 0 days.

(21) Appl. No.: 14/286,824

(22) Filed: May 23, 2014

Related U.S. Application Data

(60) Provisional application No. 61/831,021, filed on Jun. 4, 2013.

(51) Int. Cl.
*A45C 13/00* (2006.01)
*A45C 13/30* (2006.01)

(52) U.S. Cl.
CPC ..... *A45C 13/30* (2013.01); *A45C 13/001* (2013.01); *A45C 2013/306* (2013.01)

(58) Field of Classification Search
CPC .... A45C 7/0045; A45C 13/20; A45C 13/001; A45C 13/00; A45C 2013/306; A44B 11/06
USPC ..... 190/102, 108; 206/284; 24/197
See application file for complete search history.

(56) References Cited

U.S. PATENT DOCUMENTS

| | | | | |
|---|---|---|---|---|
| 4,273,222 | A | 6/1981 | Cassimally | |
| 4,538,709 | A | 9/1985 | Williams | |
| 5,323,886 | A * | 6/1994 | Chen | 190/18 A |
| 5,829,559 | A | 11/1998 | Nordstrom | |
| 5,842,673 | A | 12/1998 | Fenton | |
| 5,890,571 | A | 4/1999 | Sadow | |
| 6,347,693 | B1 * | 2/2002 | Chen | 190/102 |
| 7,364,129 | B1 * | 4/2008 | Levari, Jr. | 248/460 |
| 7,841,453 | B2 * | 11/2010 | Gold et al. | 190/102 |
| 9,033,125 | B2 * | 5/2015 | Herold | 190/18 A |
| 2004/0021353 | A1 * | 2/2004 | Lozano et al. | 297/255 |
| 2006/0102672 | A1 * | 5/2006 | Godshaw | 224/572 |
| 2010/0270116 | A1 | 10/2010 | Wilson | |

* cited by examiner

*Primary Examiner* — Anita M King
(74) *Attorney, Agent, or Firm* — RG Patent Consulting, LLC; Rachel Gilboy

(57) ABSTRACT

The modular luggage transport system attaches to a wheeled piece of luggage on front and back sides, via straps with connectors. A hinged base plate and hinged toe plate pivot down to allow additional pieces of luggage to rest on the hinged base plate. Straps with connectors are then connected, securing the additional pieces of luggage to the wheeled piece of luggage for transportation to a desired location as needed.

20 Claims, 5 Drawing Sheets

MODULAR LUGGAGE TRANSPORT SYSTEMS

CROSS-REFERENCE TO RELATED APPLICATION

The present application is related to and claims priority from prior provisional application Ser. No. 61/831,021, filed Jun. 4, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of luggage attachment means and more specifically relates to a modular luggage transport system.

2. Description of the Related Art

Many people travel between locations for work and/or pleasure. Items may be needed when and where the traveler travels. To reach destinations with items luggage may be used. Some luggage is carried and others may have wheels. Wheeled luggage can be very convenient in many situations, but does not solve all luggage transport problems. When a person has multiple suitcases and bags to carry, the process can become very difficult and cumbersome. Some devices exist that allow different pieces of luggage to connect to one another in series, but these designs tend to be inconvenient or very limited in their use. A convenient means for safely carrying multiple pieces of luggage is desirable.

Various attempts have been made to solve the above-mentioned problems such as those found in U.S. Pat. No. 4,538,709 to Marvin E. Williams; U.S. Pat. No. 5,829,559 to Mark Nordstrom; and U.S. Pat. No. 5,842,673 to Timm Fenton. This art is representative of luggage attachment means. None of the above inventions and patents, taken either singly or in combination, is seen to describe the invention as claimed.

Ideally, a luggage attachment should provide ease of use, yet would operate reliably and be manufactured at a modest expense. Thus, a need exists for a reliable modular luggage transport system to increase a user's ability to transport multiple pieces of luggage with ease at once, and to avoid the above-mentioned problems.

BRIEF SUMMARY OF THE INVENTION

In view of the foregoing disadvantages inherent in the known luggage attachment art, the present invention provides a novel modular luggage transport system. The general purpose of the present invention, which will be described subsequently in greater detail, is to provide a user with the capability to transport multiple pieces of luggage simultaneously with ease.

A modular luggage transport system is described herein in a preferred embodiment comprising: a modular luggage transport assembly having a front plate with a hinged base plate, a hinged toe plate, a plurality of retaining straps, and a plurality of rotatable footings. The present invention may further comprise a back plate having a plurality of support straps. The plurality of retaining straps and plurality of support straps are made of sturdy nylon, while the front plate and back plate comprise a lightweight ferrous material.

Adjustable male connectors are attached to the plurality of retaining straps, and adjustable female connectors are attached to the plurality of support straps, which are structured and arranged to attach luggage to the modular luggage transport assembly. The modular luggage transport assembly is attachable to a piece of wheeled luggage to increase transportable luggage capacity to a destination. The front plate further has elongated slots for the plurality of retaining straps to pass through and further secure luggage to the modular luggage transport assembly.

The hinged base plate is attached to a bottom edge of the front plate allowing the hinged base plate to rotate to a useable position as needed. Luggage is set directly on the hinged base plate when attached to wheeled luggage. The hinged toe plate is attached to a leading edge of the hinged base plate allowing the hinged toe plate to pivot to a useable position for use, and provide added support for luggage. The hinged toe plate is further able to be manufactured in various lengths, and with a heavy duty canvas material to increase flexibility and provide added support for different sized pieces of luggage. The plurality of retaining straps and plurality of support straps are attached to the front plate and back plate respectively, along an outside edge to facilitate attachment of the front plate to the back plate, which are parallel mounted on opposing sides of wheeled luggage when in an in use condition.

The plurality of rotatable footings are attached to a bottom side of the hinged base plate; preferably pivot ninety degrees in a downward arc to rest on a flat planer surface, and provide vertical stability when the wheeled luggage is in an upright and stationary position. The plurality of rotatable footings fold flat against the bottom of the hinged base plate when not in use. The back plate comprises a substantially flat plate to allow compatibility with an outer surface of wheeled luggage, and provides stability for the front plate when attached.

The front plate and back plate attach on a top side, and along both sides of wheeled luggage with a plurality of retaining straps, and a plurality of support straps, and an optional strap is available for added support which connects near to a bottom edge of the front plate and bottom of the back plate. The modular luggage transport assembly attaches to a piece of wheeled luggage, and is constructed and arranged to allow a user to attach multiple pieces of luggage to a single wheeled piece of luggage and transport to a desired location, and folds to a substantially flat device for storage when not in use. The invention is handy for use by travelers.

The present invention holds significant improvements and serves as a modular luggage transport system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, modular luggage transport system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention, and variations thereof relate to a luggage attachment device and more particularly to a modular luggage transport system as used to improve the ability to transport multiple pieces of luggage simultaneously to a desired location.

Generally speaking, the modular luggage transport system of the present invention attaches to a wheeled piece of luggage on front and back sides, via straps with connectors. The hinged base plate and hinged toe plate pivot down, and the rotatable footings rotate 90 degrees to allow additional pieces of luggage to rest on the hinged base plate. The straps with connectors are then connected, securing the additional pieces of luggage to the wheeled piece of luggage for transportation to a location as needed. When no longer needed for use, the modular luggage transport assembly is able to be folded into a substantially flat device for storage within a supplied storage bag.

Figure 1:
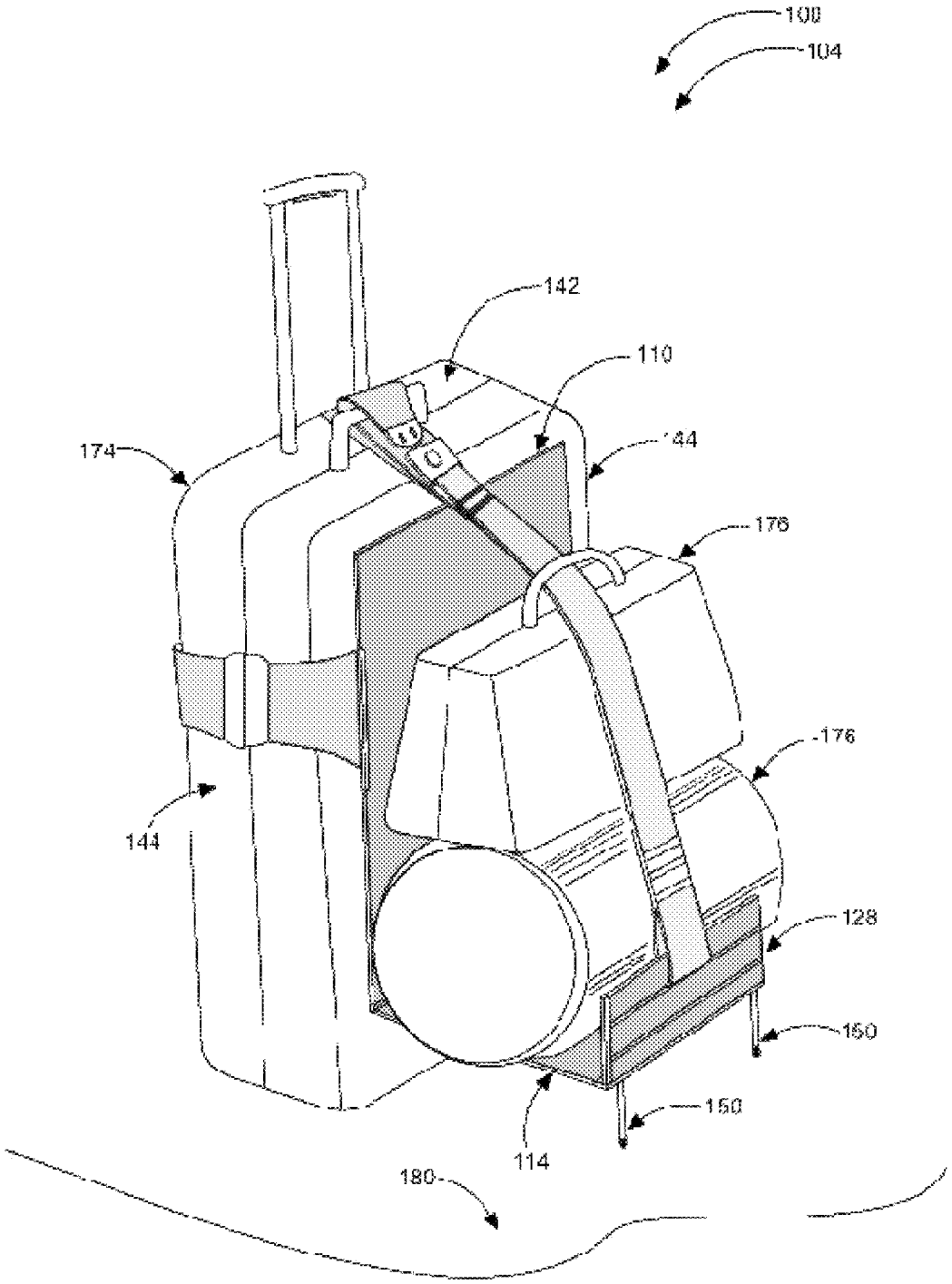
FIG. 1 shows a perspective view illustrating the modular luggage transport system in an in-use condition according to an embodiment of the present invention.

Referring to the drawings by numerals of reference there is shown in FIG. 1, a perspective view illustrating an in-use condition 104 of modular luggage transport system 100 according to an embodiment of the present invention.

Modular luggage transport system 100 in a preferred embodiment comprises: modular luggage transport assembly 102 having front plate 110 with hinged base plate 114, hinged toe plate 128, plurality of retaining straps 140, and plurality of rotatable footings 150. It further comprises back plate 160 having plurality of support straps 164. Plurality of retaining straps 140 and plurality of support straps 164 may be made of sturdy nylon, while front plate 110 and back plate 160 preferably comprise a lightweight ferrous material. Upon reading this specification, it should be appreciated that, under appropriate circumstances, considering such issues as user preferences, design preference, structural requirements, marketing preferences, cost, available materials, technological advances, etc., other materials such as, for example, plastics, fabrics, ferrous and non-ferrous, composite materials, etc., may be sufficient.

Figure 2:
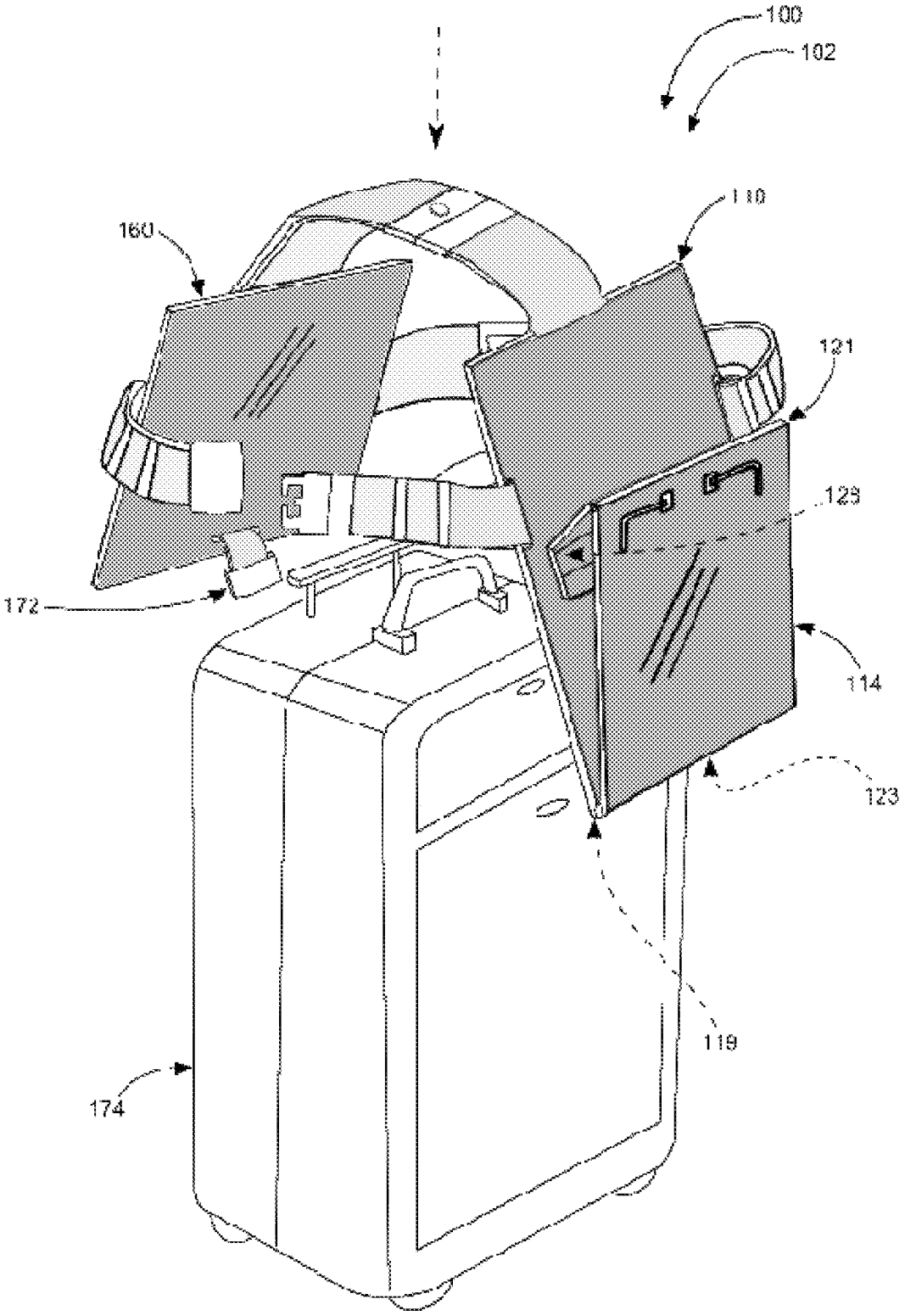
FIG. 2 is an exploded view illustrating a modular luggage transport assembly according to an embodiment of the present invention of FIG. 1.

Referring now to FIG. 2, an exploded view illustrating modular luggage transport assembly 102 according to an embodiment of the present invention of FIG. 1.

Adjustable male connectors 117 are attached to plurality of retaining straps 140, and adjustable female connectors 166 are attached to plurality of support straps 164, which are structured and arranged to attach wheeled luggage 174 to modular luggage transport assembly 102. Modular luggage transport assembly 102 is attachable to a piece of wheeled luggage 174 to increase transportable luggage capacity to a destination.

Front plate 110 further has elongated slots 111 for plurality of retaining straps 140 to pass through and further secure additional luggage 176 to modular luggage transport assembly 102. Hinged base plate 114 is attached to bottom edge 119 of front plate 110 allowing hinged base plate 114 to rotate to a useable position as needed. Rotatable footings 150 are rotated 90 degrees to provide vertical support. Additional luggage 176 is set directly on hinged base plate 114 when attached to wheeled luggage 174. Hinged toe plate 128 is attached to leading edge 121 of hinged base plate 114 allowing hinged toe plate 128 to pivot to a useable position for use, and provide added support for additional luggage 176. Hinged toe plate 128 is further able to be manufactured in various lengths, and with heavy duty canvas material 178 to increase flexibility and provide added support for different sized pieces of luggage.

Figure 3:
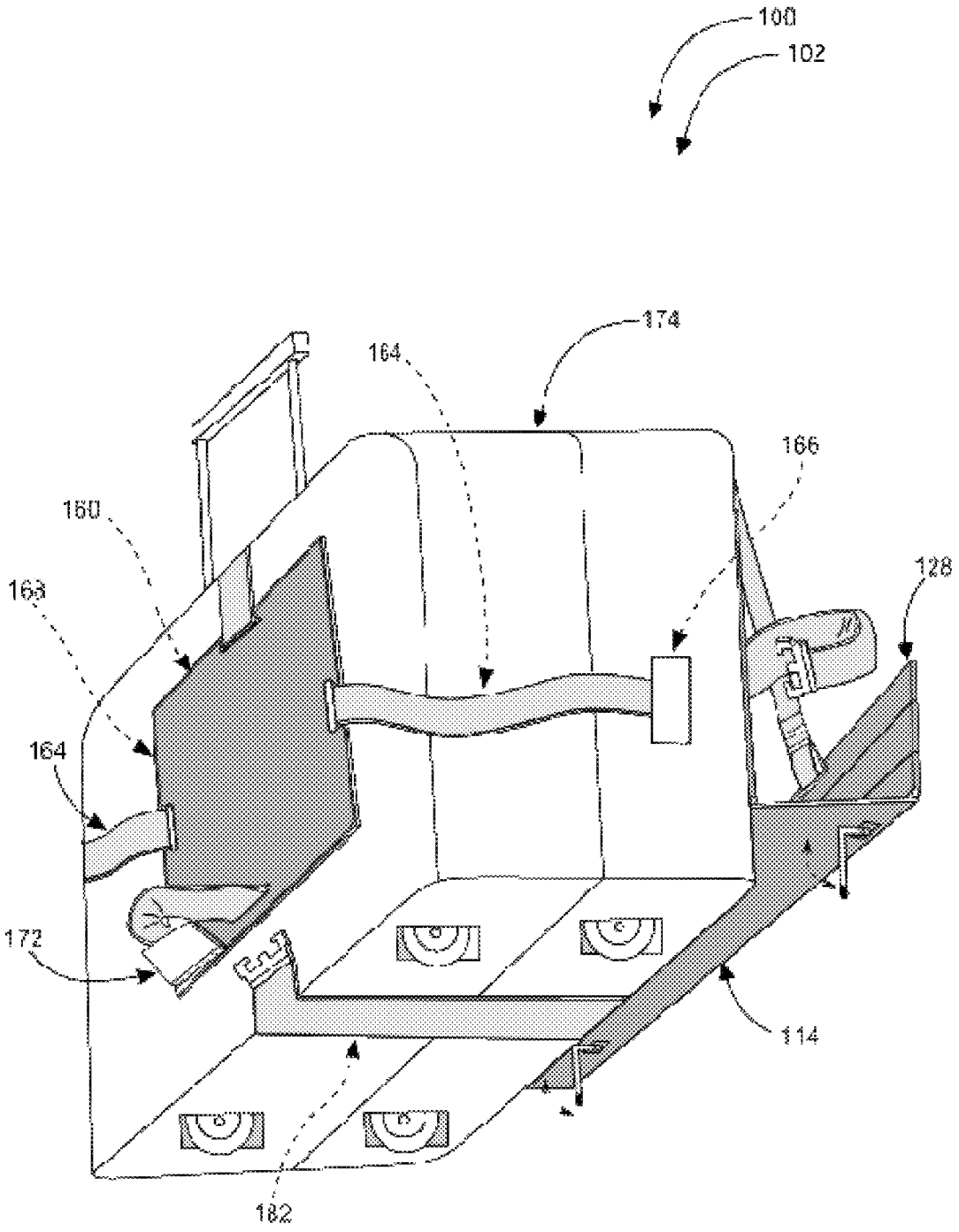
FIG. 3 is a bottom view illustrating the modular luggage transport assembly with optional strap according to an embodiment of the present invention of FIG. 1.

Referring now to FIG. 3, a bottom view illustrating modular luggage transport assembly 102 according to an embodiment of the present invention of FIG. 1.

Plurality of retaining straps 140 and plurality of support straps 164 are attached to front plate 110 and back plate 160 respectively, along outside edge 168 to facilitate attachment of front plate 110 to back plate 160, which are parallel mounted on opposing sides of wheeled luggage 174 when in an in use condition 104. Plurality of rotatable footings 150 are attached to bottom edge 119 of hinged base plate 114, and pivot ninety degrees in a downward arc to rest on a flat planer surface 180, and provide vertical stability when wheeled luggage 174 is in an upright and stationary position. Plurality of rotatable footings 150 fold flat against bottom 170 of hinged base plate 114 when not in use.

Figure 4:
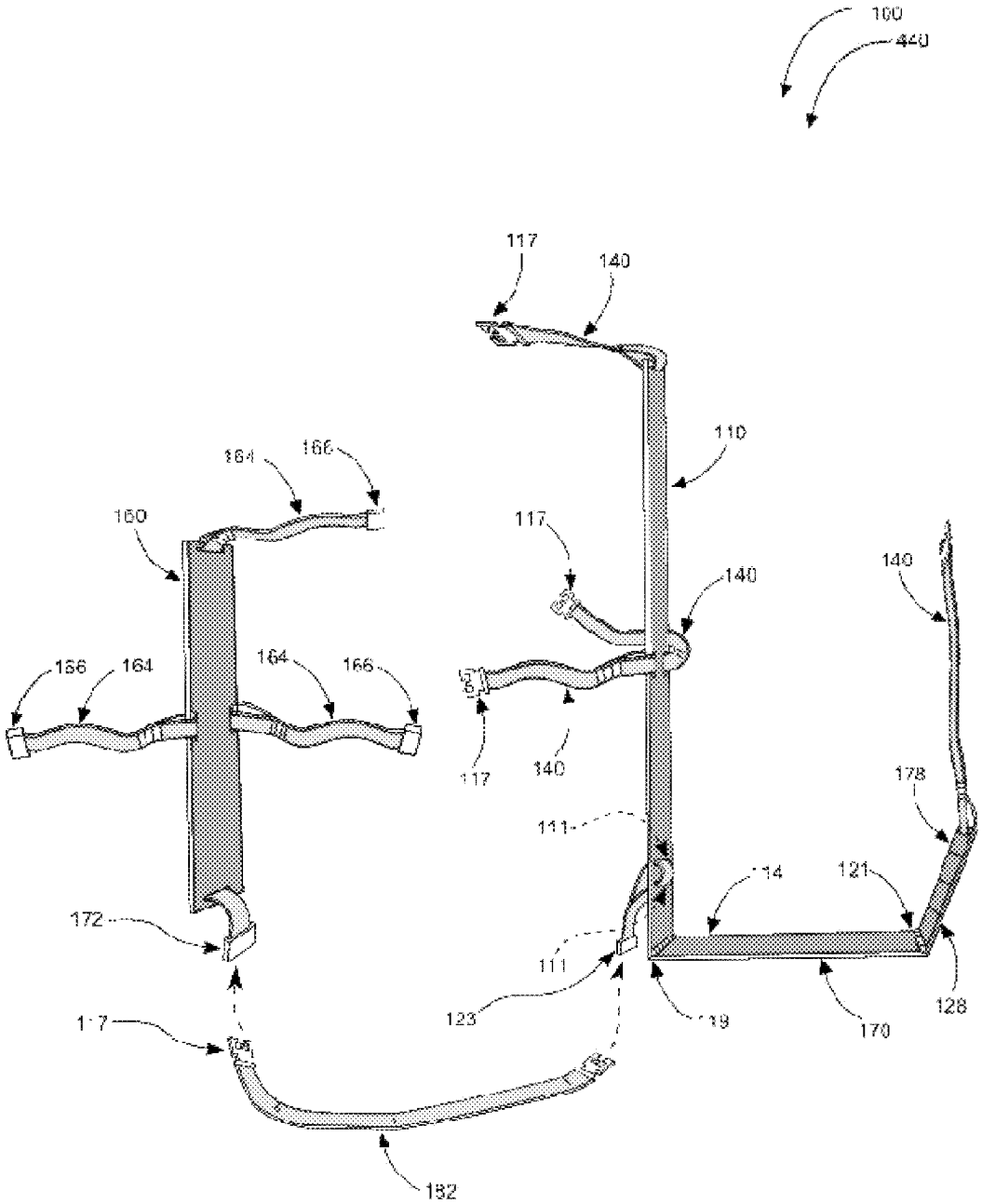
FIG. 4 is another perspective view illustrating the modular luggage transport assembly according to an embodiment of the present invention of FIG. 1.

Referring now to FIG. 4, showing another perspective view of modular luggage transport assembly 102 according to an embodiment of the present invention of FIG. 1.

Back plate 160 comprises a substantially flat plate to allow compatibility with an outer surface of wheeled luggage 174, and provides stability for front plate 110 when attached. Front plate 110 and back plate 160 attach on top side 142, and along sides 144 of wheeled luggage 174 with plurality of retaining straps 140, and plurality of support straps 164, and an optional strap 182 is available for added support which connects near to bottom edge connector 123 of front plate 110 and bottom connector 172 of back plate 160. Modular luggage transport assembly 102 attaches to a piece of wheeled luggage 174, and is constructed and arranged to allow a user to attach multiple pieces of additional luggage 176 to a single piece of wheeled luggage 174 and transport to a desired location, then folds to a substantially flat device for storage when not in use.

Modular luggage transport system 100 may be sold as kit 440 comprising the following parts: at least one front plate 110; at least one hinged base plate 114; at least one hinged toe plate 128; at least one back plate 160; at least one plurality of retaining straps 140; at least one plurality of support straps 164; and at least one set of user instructions. Modular luggage transport system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
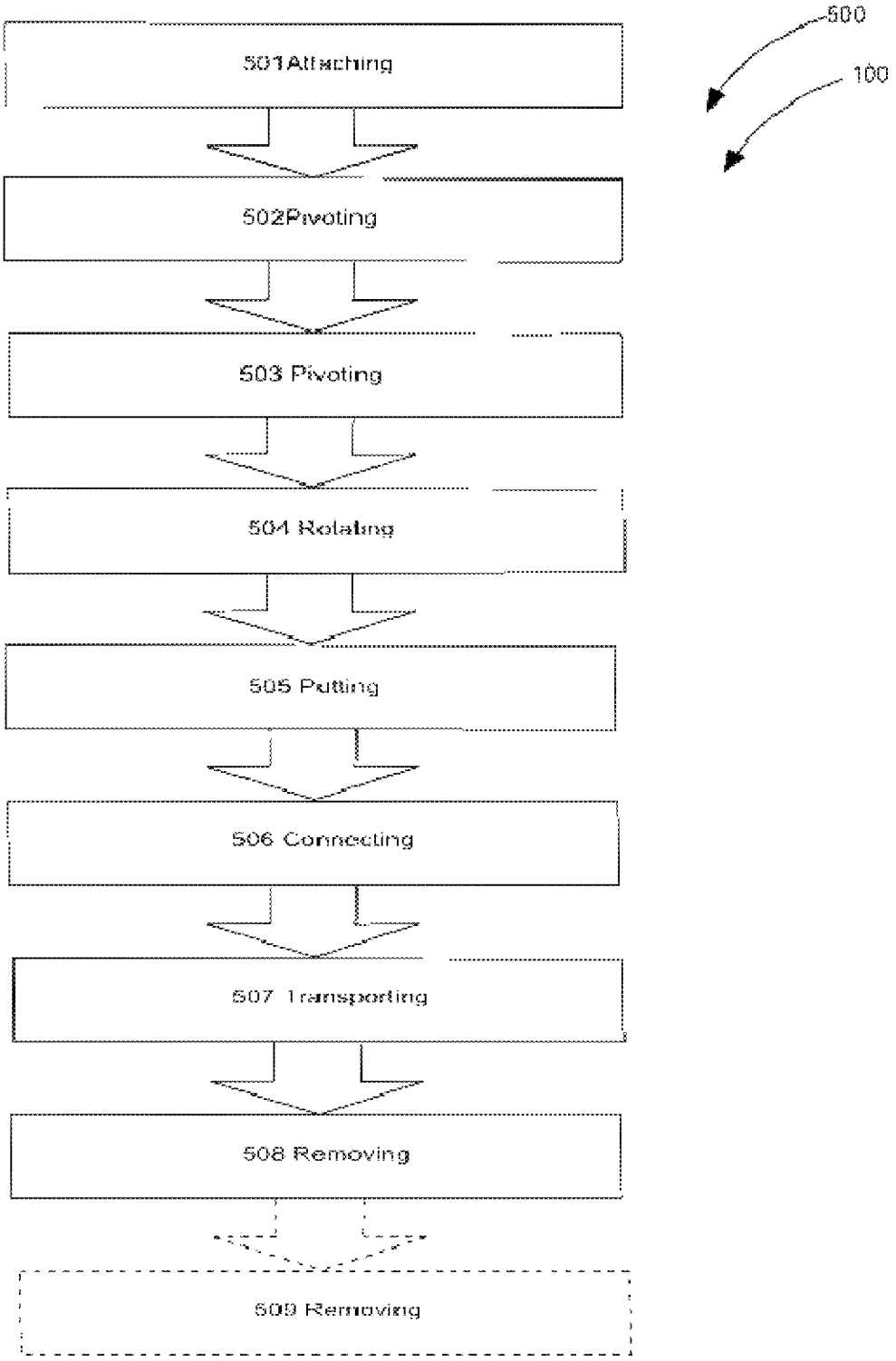
FIG. 5 is a flowchart illustrating a method of use for the modular luggage transport system according to an embodiment of the present invention of FIGS. 1-4.

Referring now to FIG. 5, showing a flowchart illustrating a method of use 500 for modular luggage transport system 100 according to an embodiment of the present invention of FIGS. 1-4.

A method of use 500 preferably comprises step one 501 attaching modular luggage transport assembly 102 to a piece of wheeled luggage 174, step two 502 pivoting plurality of rotatable footings down to a useable position, step three 503 pivoting hinged base plate 114 down to a useable position, step four 504 rotating hinged toe plate 128 outward to a useable position, step five 505 putting additional luggage 176 on hinged base plate 114, step six 506 connecting plurality of retaining straps 140 over additional luggage 176, step seven 507 transporting modular luggage transport assembly 102 to a desired location, step eight 508 removing additional luggage 176 from modular luggage transport assembly 102. The method may further comprise step nine 509 removing modular luggage transport assembly 102 from wheeled luggage 174 and folding flat for storage.

It should be noted that step 509 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A modular luggage transport system comprising:
a modular luggage transport assembly having;
a front plate having;
a hinged base plate;
a hinged toe plate;
a plurality of retaining straps; and
a plurality of rotatable footings; and
a back plate having;
a plurality of support straps;
wherein said modular luggage transport assembly comprises said front plate and said back plate in functional combination;
wherein said modular luggage transport assembly is removably attachable to a piece of wheeled luggage to increase transportable luggage capacity to a destination;
wherein said hinged toe plate, said plurality of retaining straps, and said plurality of rotatable footings in functional combination;
wherein said hinged base plate is non-removably attached to a bottom edge of said front plate allowing said hinged base plate to rotate to a useable position as needed;
wherein said hinged toe plate is non-removably attached to a leading edge of said hinged base plate allowing said hinged toe plate to pivot to a useable position for use as needed;
wherein said plurality of retaining straps are attached to said front plate along an outside edge to facilitate attachment of said front plate to said back plate;
wherein said plurality of rotatable footings are non-removably attached to a bottom side of said hinged base plate to provide stability when said wheeled luggage is in an upright position;
wherein said back plate comprises a substantially flat plate to allow compatibility with a surface of said wheeled luggage;
wherein said plurality of support straps are non-removably attached to said back plate along said outside edge to facilitate attachment of said back plate to said front plate; and
wherein said modular luggage transport assembly attaches to a piece of said wheeled luggage via said plurality of retaining straps on said front plate, and said plurality of support straps on said back plate, allowing a user to attach multiple pieces of luggage to a single wheeled piece of luggage and transport to a desired location.

2. The modular luggage transport system of claim 1 wherein luggage is set directly on said hinged base plate when said modular luggage transport assembly is removably attached to said wheeled luggage.

3. The modular luggage transport system of claim 2 wherein said hinged toe plate provides stability for said luggage while in an in-use condition.

4. The modular luggage transport system of claim 3 wherein said back plate provides stability for said front plate when removably attached to said wheeled luggage.

5. The modular luggage transport system of claim 4 wherein said front plate and said back plate are attached to said wheeled luggage via said plurality of retaining straps and said plurality of support straps.

6. The modular luggage transport system of claim 5 wherein said back plate comprises said plurality of support straps having adjustable female connectors attachable to said front plate.

7. The modular luggage transport system of claim 6 wherein said front plate comprises said plurality of retaining straps having adjustable male connectors attachable to said back plate.

8. The modular luggage transport system of claim 7 wherein said front plate and said back plate attach on a top side, and along both sides of said wheeled luggage with said plurality of retaining straps, and said plurality of support straps.

9. The modular luggage transport system of claim 8 wherein an optional strap is available for added support which connects to a bottom edge connector of said front plate and a bottom connector of said back plate.

10. The modular luggage transport system of claim 1 wherein said modular luggage transport assembly folds to a substantially flat device for storage, within said wheeled luggage, when not in use.

11. The modular luggage transport system of claim 10 wherein said modular luggage transport assembly comprises sturdy nylon retaining straps, lightweight ferrous said front plate and said back plate, and durable plastic said adjustable male connectors, and said adjustable female connectors, for longevity of use and ease of transportation.

12. The modular luggage transport system of claim 9 wherein said front plate comprises elongated slots for said plurality of retaining straps to pass through and further secure said luggage to said modular luggage transport assembly.

13. The modular luggage transport system of claim 1 wherein said plurality of rotatable footings fold flat against said bottom side of said hinged base plate when not in use.

14. The modular luggage transport system of claim 13 wherein said plurality of rotatable footings pivot ninety degrees in a downward arc to rest on a flat planer surface and provide vertical support for said modular luggage transport assembly when in an upright and stationary position.

15. The modular luggage transport system of claim 8 wherein said front plate and said back plate are parallel mounted on opposing sides of said wheeled luggage when in said in use condition.

16. The modular luggage transport system of claim 3 wherein said hinged toe plate is able to be manufactured in various lengths, with a heavy duty canvas material to increase flexibility and provide added support for different sized pieces of said luggage.

17. A modular luggage transport system comprising:

a modular luggage transport assembly having;

a front plate having;

a hinged base plate;

a hinged toe plate;

a plurality of retaining straps; and a plurality of rotatable footings; and a back plate having;

a plurality of support straps;

wherein said modular luggage transport assembly comprises said front plate and said back plate in functional combination;

wherein said modular luggage transport assembly comprises sturdy nylon retaining straps, lightweight ferrous said front plate and said back plate, and durable plastic adjustable male connectors, and adjustable female connectors, for longevity of use and ease of transportation;

wherein said modular luggage transport assembly is removably attachable to a piece of wheeled luggage to increase transportable luggage capacity to a destination;

wherein said front plate comprises said hinged base plate, said hinged toe plate, said plurality of retaining straps, and said plurality of rotatable footings in functional combination;

wherein said front plate comprises elongated slots for said plurality of retaining straps to pass through and further secure said luggage to said modular luggage transport assembly;

wherein said hinged base plate is non-removably attached to a bottom edge of said front plate allowing said hinged base plate to rotate to a useable position as needed;

wherein luggage is set directly on said hinged base plate when said modular luggage transport assembly is removably attached to said wheeled luggage;

wherein said hinged toe plate is non-removably attached to a leading edge of said hinged base plate allowing said hinged toe plate to pivot to a useable position for use as needed;

wherein said hinged toe plate is able to be manufactured in various lengths, with a heavy duty canvas material to increase flexibility and provide added support for different sized pieces of additional luggage;

wherein said hinged toe plate provides stability for said additional luggage while in an in-use condition;

wherein said plurality of retaining straps are attached to said front plate along an outside edge to facilitate attachment of said front plate to said back plate;

wherein said front plate and said back plate are parallel mounted on opposing sides of said wheeled luggage when in said in use condition;

wherein said plurality of rotatable footings are non-removably attached to a bottom side of said hinged base plate to provide stability when said wheeled luggage is in an upright position;

wherein said plurality of rotatable footings pivot ninety degrees in a downward arc to rest on a flat planer surface and provide vertical support for said modular luggage transport assembly when in an upright and stationary position;

wherein said plurality of rotatable footings fold flat against said bottom side of said hinged base plate when not in use;

wherein said back plate comprises a substantially flat plate to allow compatibility with a surface of said wheeled luggage;

wherein said back plate provides stability for said front plate when removably attached to said wheeled luggage;

wherein said back plate comprises said plurality of support straps having adjustable female connectors attachable to said front plate;

wherein said front plate comprises said plurality of retaining straps having adjustable male connectors attachable to said back plate;

wherein said plurality of support straps are non-removably attached to said back plate along said outside edge to facilitate attachment of said back plate to said front plate;

wherein said front plate and said back plate are attached to said wheeled luggage via said plurality of retaining straps and said plurality of support straps;

wherein said front plate and said back plate attach on a top side, and along both sides of said wheeled luggage with said plurality of retaining straps, and said plurality of support straps;

wherein an optional strap is available for added support which connects to said bottom edge connector of said front plate and said bottom connector of said back plate;

wherein said modular luggage transport assembly attaches to a piece of said wheeled luggage via said plurality of retaining straps on said front plate, and said plurality of support straps on said back plate, allowing a user to attach multiple pieces of luggage to a single wheeled piece of luggage and transport to a desired location; and wherein said modular luggage transport assembly folds to a substantially flat device for storage when not in use.

18. The modular luggage transport system of claim 17 further comprising a kit including: one said front plate, one said hinged base plate, one said hinged toe plate, one said back plate, one said plurality of retaining straps, one said plurality of support straps, and at least one set of user instructions for use.

19. A method of using a modular luggage transport system comprising the steps of:

attaching a modular luggage transport assembly to a piece of wheeled luggage, pivoting plurality of rotatable footings down to a useable position, pivoting a hinged base plate down to a useable position, rotating a hinged toe plate outward to a useable position, putting additional luggage on said hinged base plate, connecting retaining straps over said additional luggage, transporting said modular luggage transport assembly to a desired location, and removing said additional luggage from said modular luggage transport assembly.

20. The method of claim 19 may further comprise the step of: removing said modular luggage transport assembly and folding for storage, within said wheeled luggage.

* * * * *